US008800986B2

(12) United States Patent
Tomatsu

(10) Patent No.: US 8,800,986 B2
(45) Date of Patent: Aug. 12, 2014

(54) IMAGE FORMING APPARATUS

(71) Applicant: Yoshiya Tomatsu, Kasugai (JP)

(72) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/775,344

(22) Filed: Feb. 25, 2013

(65) Prior Publication Data

US 2013/0223906 A1 Aug. 29, 2013

(30) Foreign Application Priority Data

Feb. 27, 2012 (JP) ..... 2012-039753

(51) Int. Cl.
*B65H 1/08* (2006.01)
*B65H 3/06* (2006.01)

(52) U.S. Cl.
CPC ..... *B65H 3/0684* (2013.01); *B65H 2403/51* (2013.01); *B65H 2403/533* (2013.01); *B65H 2403/722* (2013.01)
USPC ..... 271/127; 271/126

(58) Field of Classification Search
CPC ..... B65H 2403/51; B65H 2403/533; B65H 2403/722; B65H 3/0684; B65H 2511/152
USPC ..... 271/147, 126, 127, 109, 113
See application file for complete search history.

(56) References Cited

U.S. PATENT DOCUMENTS

| | | | | |
|---|---|---|---|---|
| 5,501,444 | A * | 3/1996 | Yukimachi et al. | 271/127 |
| 7,357,388 | B2 * | 4/2008 | Dan | 271/127 |
| 7,461,840 | B2 | 12/2008 | Hattori | |
| 7,513,496 | B2 * | 4/2009 | Hattori | 271/127 |
| 7,641,189 | B2 * | 1/2010 | Nobe et al. | 271/127 |
| 7,681,877 | B2 * | 3/2010 | Won | 271/127 |
| 7,984,902 | B2 * | 7/2011 | Kuroda | 271/156 |
| 8,224,229 | B2 | 7/2012 | Okamoto | |
| 8,276,906 | B2 * | 10/2012 | Yamamoto | 271/127 |
| 2005/0218584 | A1 * | 10/2005 | Dan | 271/127 |
| 2005/0220517 | A1 * | 10/2005 | Matsushima et al. | 399/388 |
| 2006/0113722 | A1 * | 6/2006 | Hattori | 271/121 |
| 2006/0157915 | A1 * | 7/2006 | Ogawa | 271/126 |
| 2006/0180986 | A1 * | 8/2006 | Hattori | 271/110 |
| 2006/0180987 | A1 * | 8/2006 | Hattori | 271/117 |
| 2008/0089714 | A1 * | 4/2008 | Dan | 399/167 |
| 2008/0099985 | A1 * | 5/2008 | Ogawa | 271/226 |

(Continued)

FOREIGN PATENT DOCUMENTS

| | | | |
|---|---|---|---|
| JP | 11-322090 | A | 11/1999 |
| JP | 2006-176321 | A | 7/2006 |

(Continued)

*Primary Examiner* — Patrick Cicchino
(74) *Attorney, Agent, or Firm* — Banner & Witcoff, Ltd.

(57) ABSTRACT

There is provided an image forming apparatus which includes an body, a feeding tray, a pickup roller, a roller supporting mechanism which supports the pickup roller, a pressing plate which elevates a sheet at the time of sheet feeding, an ascending mechanism which makes the pressing plate ascent, a drive source which is provided to the body, a drive gear, a one-way clutch mechanism which transmits the driving force to the ascending mechanism, a coupling member which moves in conjunction with a vertical movement of the pickup roller, and a transmission-state switching mechanism which is engaged with the coupling member, and which allows or inhibits the transmission of the driving force from the drive gear to the one-way clutch mechanism, in accordance with the movement of the coupling member.

6 Claims, 8 Drawing Sheets

(56) References Cited

U.S. PATENT DOCUMENTS

| | | | | |
|---|---|---|---|---|
| 2008/0309004 | A1* | 12/2008 | Won | 271/147 |
| 2009/0008868 | A1* | 1/2009 | Kuroda | 271/162 |
| 2010/0104311 | A1 | 4/2010 | Okamoto | |
| 2013/0134656 | A1* | 5/2013 | Akatsuka et al. | 271/147 |

FOREIGN PATENT DOCUMENTS

| | | | |
|---|---|---|---|
| JP | 2007-269462 | A | 10/2007 |
| JP | 2009-007118 | A | 1/2009 |
| JP | 2010-105768 | A | 5/2010 |

* cited by examiner

IMAGE FORMING APPARATUS

CROSS REFERENCE TO RELATED APPLICATION

The present application claims priority from Japanese Patent Application No. 2012-039753, filed on Feb. 27, 2012, the disclosure of which is incorporated herein by reference in its entirety.

BACKGROUND OF THE INVENTION

1. Field of the Invention

The present invention relates to an image forming apparatus which includes a pickup roller which transports a sheet placed on a paper feeding tray, and a pressing plate which applies a bias to the sheet to press on the pickup roller.

2. Description of the Related Art

An image forming apparatus which includes a roller supporting mechanism which supports a pickup roller to be movable vertically, an ascending mechanism which makes the pressing plate ascend toward the pickup roller, an a coupling member which moves in conjunction with a vertical movement of the pickup roller, a drive gear to which a driving force from a drive source is transmitted, and a transmission-state switching mechanism which is engaged with the coupling member, and which allows or inhibits the transmission of the driving force from the drive gear to the ascending mechanism according to the movement of the coupling member, has hitherto been known. In this technology, as the number of sheets in the paper feeding tray goes on decreasing, and the pickup roller descends, the movement of the pickup roller is transmitted to the transmission-state switching mechanism via the coupling member, and a state of transmission from the drive gear to the ascending mechanism is switched from an inhibited state to an allowed state.

Accordingly, the pressing plate ascends up, and the pickup roller is elevated by the pressing plate via the sheet, returning to an initial position. Therefore, due to the pickup roller positioned at the initial position, it is possible to transport a sheet once again in a favorable manner. In other words, in this technology, without providing a sensor which detects a decrease in the number of sheets, it is possible to move automatically a position of the pickup roller and a position of the pressing plate to appropriate positions, in accordance with the decrease in the number of sheets, by a mechanical structure.

SUMMARY OF THE INVENTION

However, in the abovementioned technology, since the transmission-state switching mechanism includes a planetary gear mechanism having a sun gear, a ring gear, and a carrier, and a plurality of hooks, there has been a problem that the structure of the transmission-state switching mechanism becomes complicated.

Therefore, an object of the present invention is to simplify the structure of the transmission-state switching mechanism.

According to an aspect of the present invention, there is provided an image forming apparatus which forms an image on a sheet, a body;

a feeding tray configured to stack a plurality of sheets thereon;

a pickup roller configured to contact with an uppermost sheet of the sheets stacked on the feeding tray, from an upper side;

a roller supporting mechanism configured to support the pickup roller to be movable in upward and downward directions;

a pressing plate swingably provided to the feeding tray and configured to lift up the sheets at the time of feeding the sheets;

a lifting mechanism configured to lift the pressing plate;

a drive source provided to the body;

a drive gear configured to rotate by a driving force transmitted from the drive source;

a one-way clutch mechanism configured to rotate only in one direction, and configured to transmit the driving force to the lifting mechanism;

a coupling member configured to move in conjunction with a movement of the pickup roller in the upward and downward directions; and a transmission-state switching mechanism engaged with the coupling member, and configured to allow or inhibit the transmission of the driving force from the drive gear to the one-way clutch mechanism, in accordance with the movement of the coupling member, wherein the transmission-state switching mechanism includes:

a first partially-toothless gear of which a part of an outer periphery is formed as a gear tooth portion to which the driving force is transmitted from the drive gear, and a portion other than the part of the outer periphery is formed as a partially-toothless portion to which the driving force is not transmitted from the drive gear, a second partially-toothless gear of which a part of an outer periphery is formed as a gear tooth portion which transmits the driving force to the one-way clutch mechanism, and a portion other than the part of the outer periphery is formed as a partially-toothless portion which does not transmit the driving force to the one-way clutch mechanism, an engaging portion configured to rotate in conjunction with the first partially-toothless gear, a locking member configured to be engaged with the engaging portion in conjunction with the movement of the coupling member due to an upward movement of the pickup roller, and configured to be disengaged from the engaging portion in conjunction with the movement of the coupling member due to a downward movement of the pickup roller, and a bias applying mechanism configured to apply a bias in the one direction to the first partially-toothless gear and the second partially-toothless gear at the time of engaging of at least the locking member with the engaging portion, and in the transmission-state switching mechanism, at the time of engaging of the locking member with the engaging portion, each partially-toothless portion of the first partially-toothless gear and the second partially-toothless gear faces a mechanism on an upstream side of the first partially-toothless gear, and a mechanism on a downstream side of the second partially-toothless gear, and under a condition that the locking member is disengaged from the engaging portion, the first partially-toothless gear and the second partially-toothless gear are rotated by the bias applying mechanism, and a gear-tooth portion of the first partially-toothless gear is engaged with the mechanism on the upstream side.

According to such an arrangement, it is possible to simplify the structure of the transmission-state switching mechanism as compared to a conventional structure in which the transmission-state switching mechanism formed by using a planetary gear mechanism and a plurality of locking members.

BRIEF DESCRIPTION OF THE DRAWINGS

FIG. 4A shows a state at the time of installing a paper feeding tray, and FIG. 4B shows a state at the time of start-up of paper feeding;

FIG. 7A shows a state in which, a locking arm is engaged with an engaging portion, FIG. 7B shows a state in which, the locking arm is disengaged from the engaging portion, FIG. 7C shows a state in which, a first partially-toothless gear is engaged with the drive gear, and FIG. 7D shows a state in which, a second partially-toothless gear is engaged with a clutch-side gear;

DETAILED DESCRIPTION OF THE PREFERRED EMBODIMENTS

An embodiment of the present teaching will be described below in detail with reference to the accompanying diagrams. In the following description, after describing in brief an overall structure of a laser printer as an example of an image forming apparatus, features of the present teaching will be described in detail.

Figure 1:
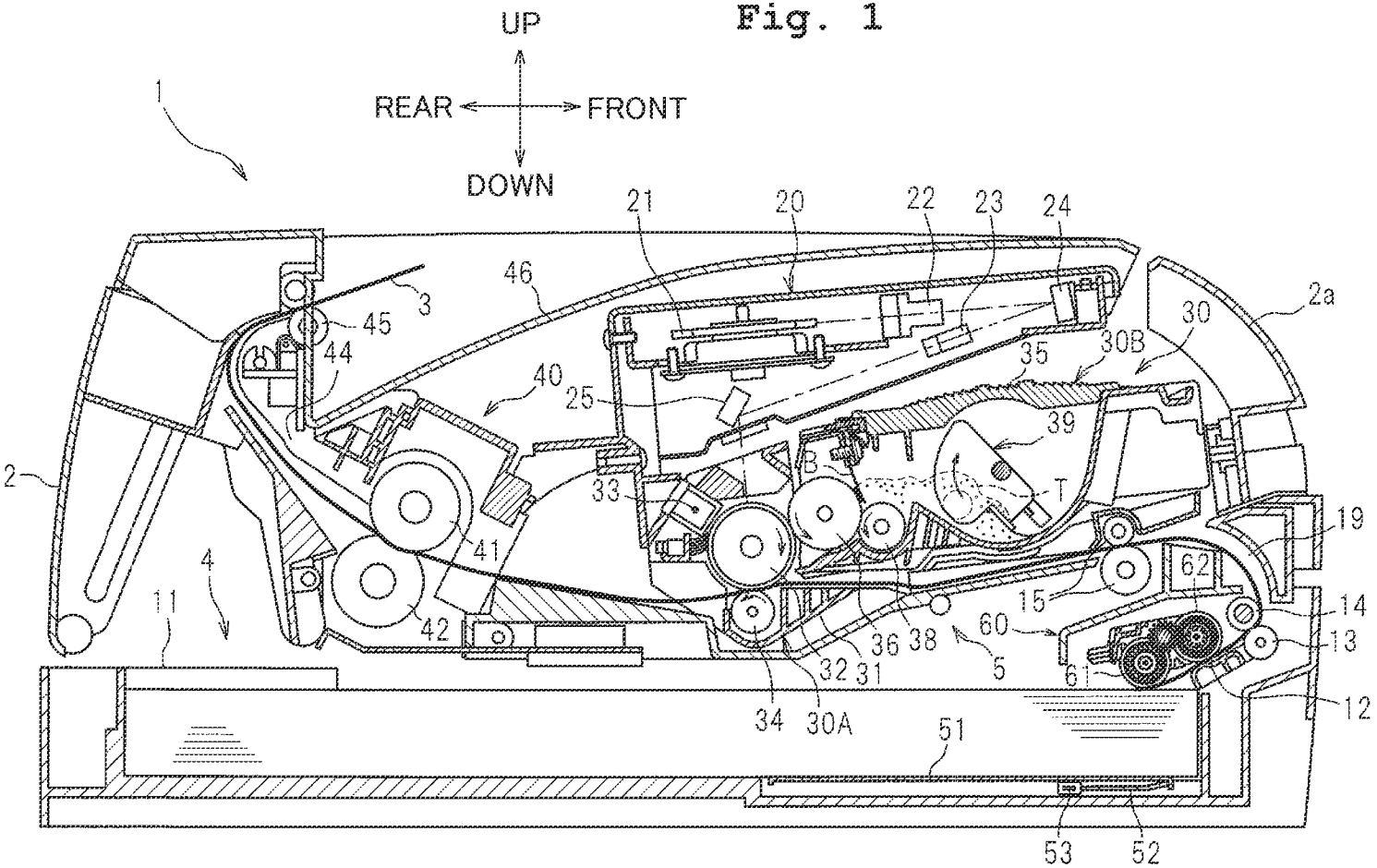
FIG. 1 is a side cross-sectional view of a laser printer according to an embodiment of the present invention.

In the following description, directions will be described with reference to a user at the time of using the laser printer. More specifically, a right side in FIG. 1 is defined as a 'front side', and a left side in FIG. 1 is defined as a 'rear side'. Note that, a frontward side of the paper sheet in FIG. 1 is defined as a 'left side', and a rearward side of the paper sheet in FIG. 1 is defined as a 'right side' (see in FIG. 2, for example). Moreover, an up-down direction in FIG. 1 is defined as a 'vertical direction'.

As shown in FIG. 1, a laser printer 1 includes a body 2, a feeder section 4 arranged for feeding a paper 3 as an example of a sheet, and an image forming section 5 for forming an image on the paper 3.

At a front side of the body 2, a front cover 2*a* which is operable is provided, and a process cartridge 30 which will be described later is detachable from an opening which is exposed when the front cover 2*a* is opened.

The feeder section 4 includes a paper feeding tray 11 as an example of a feeding tray on which the papers 3 are placed, a pressing plate 51 for lifting the papers 3 at the time of feeding, and a lifting plate 52 for lifting the pressing plate 51 from a lower side.

The paper feeding tray 11 is detachably installed on a bottom portion in the body 2.

The pressing plate 51 is installed under the papers 3, at a lower portion of the paper feeding tray 11, and is swingably provided to the paper feeding tray 11 such that a front side thereof is lifted.

The lifting plate 52 is installed at a lower side of the pressing plate 51, and elevates the pressing plate 51 by turning around upon a rotational driving force being imparted by a driving force from the body 2.

Moreover, a pickup roller 61 which makes a contact with a paper, from upper side, on the top of the papers 3 placed on the paper feeding tray 11 is arranged at an upper side in a front side of the paper feeding tray 11, and a separating roller 62 is arranged at a front side of the pickup roller 61. The separating roller 62 is arranged facing a separating pad 12 which has been fitted to the paper feeding tray 11.

A paper-dust removing roller 13 and a facing roller 14 are arranged to face at a further front side of the separating roller 62. The paper 3, after having passed between the paper-dust removing roller 13 and the facing roller 14, is turned around rearward following a track of a transportation path 19. Furthermore, a pair of resist rollers 15 is arranged at a rear side of the transportation path 19 (above the pickup roller 61).

In the feeder section 4 structured in such manner, the papers 3 inside the paper feeding tray 11 are lifted up by the lifting plate 52 and the pressing plate 51, and the uppermost paper is sent toward the separating roller 62 by the pickup roller 61. Only the uppermost paper 3 is sent toward the facing roller 14 by friction between the pickup roller 61 and the separating pad 12, and the papers 3 are transported one-by-one to the image forming section 5.

The image forming section 5 includes a scanner section 20, a process cartridge 30, and a fixing section 40.

The scanner section 20 is provided at an upper portion in the body 2, and includes, a laser emitting portion (not shown in the diagram), a polygon mirror 21 which is driven to be rotated, lenses 22 and 23, and reflecting mirrors 24 and 25. Moreover, in the scanner section 20, a laser beam travels along a path shown by alternate long and short dash lines and is irradiated by a high-speed scanning on a surface of a photosensitive drum 32 which is located inside the process cartridge 30.

The process cartridge 30 is installed at a lower side of the scanner section 20, and is detachable from the body 2. The process cartridge 30 includes a photosensitive drum cartridge 30A which supports the photosensitive drum 32, and a developer cartridge 30B having a toner T as a developer stored therein, which is detachable from the photosensitive drum cartridge 30A.

The photosensitive drum cartridge 30A includes the photosensitive drum 32, a scortoron charger 33, and a transfer roller 34, inside a photosensitive drum case 31 which forms an outer frame.

The developer cartridge 30B is detachable from the photosensitive drum cartridge 30A, and includes a developing roller 36, a layer-thickness regulating blade B, a supply roller 38, and an agitator 39, in a developer case 35 which accommodates the toner T.

In the process cartridge 30, the toner T inside the developer case 35 is supplied to the developing roller 36 by the supply roller 38, and at this time, the toner T is charged to a positive charge by frictional charging between the supply roller 38 and the developing roller 36. The toner T which has been supplied on to the developing roller 36 enters between the layer-thickness regulating blade B and the developing roller 36 with rotation of the developing roller 36, and is carried on the developing roller 36 as a thin layer of a constant thickness.

On the other hand, the surface of the photosensitive drum 32, after being charged uniformly to a positive electric potential by the scorotron charger 33, is exposed by a high-speed scanning by a laser beam from the scanner section 20. Accordingly, an electric potential of a portion which has been exposed is lowered, and an electrostatic latent image based on image data is formed. Next, when the toner T carried on the developing roller 36 is supplied to the electrostatic latent image on the photosensitive drum 32 by the rotation of the developing roller 36, a toner image is formed on the photosensitive drum 32.

Thereafter, when the paper 3 is transported between the photosensitive drum 32 and the transfer roller 34, the toner image carried on the photosensitive drum 32 is transferred to the paper 3, and an image is formed on the paper 3.

The fixing section 40 is installed at a downstream side of the process cartridge 30, and includes a heating roller 41, and a pressurizing roller 42 which is arranged to face the heating roller 41. Moreover, in the fixing section 40, the toner T which has been transferred to the paper 3 is subjected to thermal fixing while the paper 3 passes between the heating roller 41 and the pressurizing roller 42, and thereafter, the paper 3 is transported to a paper discharge path 44. The paper 3 which has been sent to the paper discharge path 44 is discharged on to a paper discharge tray 46 by a paper discharge roller 45.

<Detail Arrangement of Feeder Section>

Figure 2:
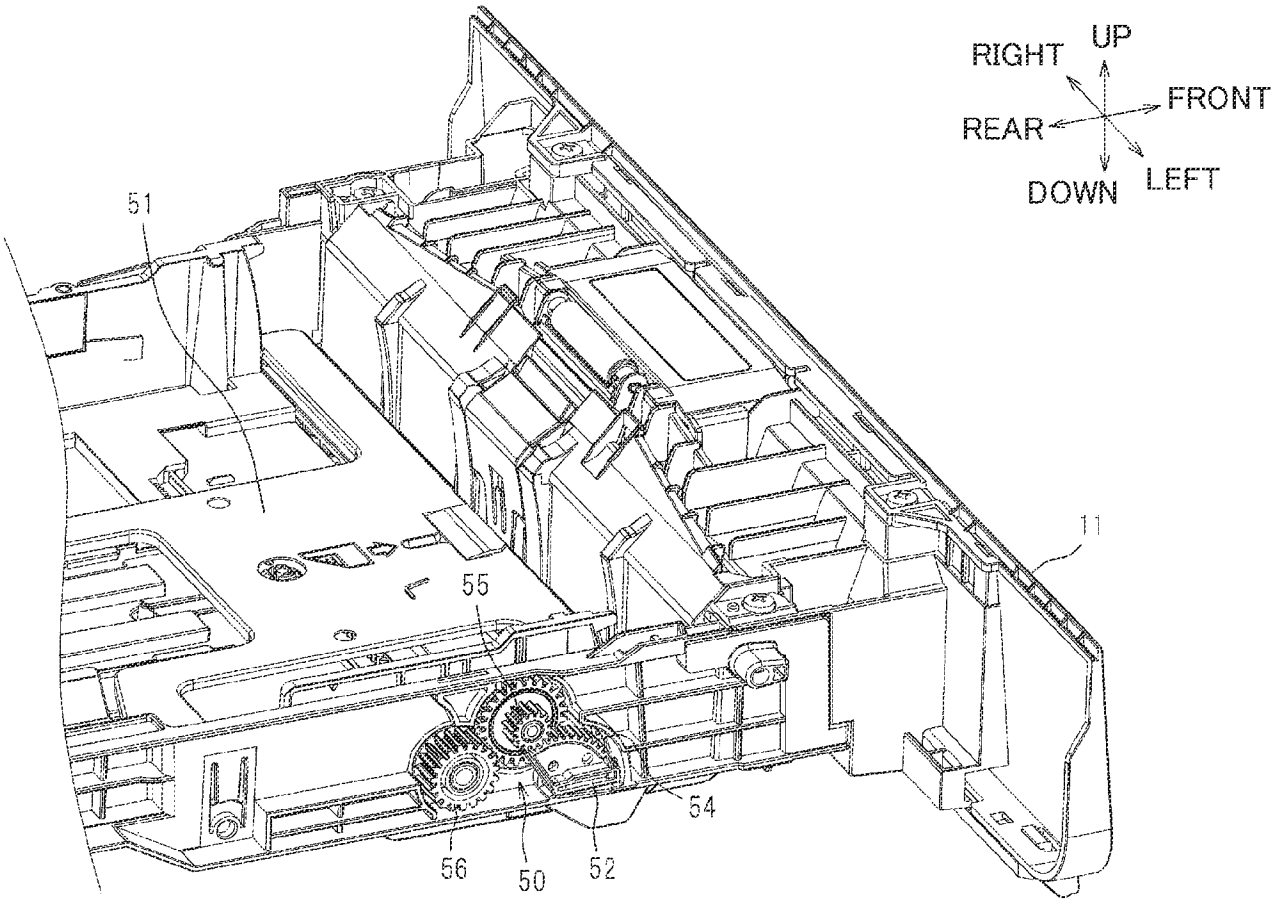
FIG. 2 is a perspective view showing an ascending mechanism.
Figure 3:
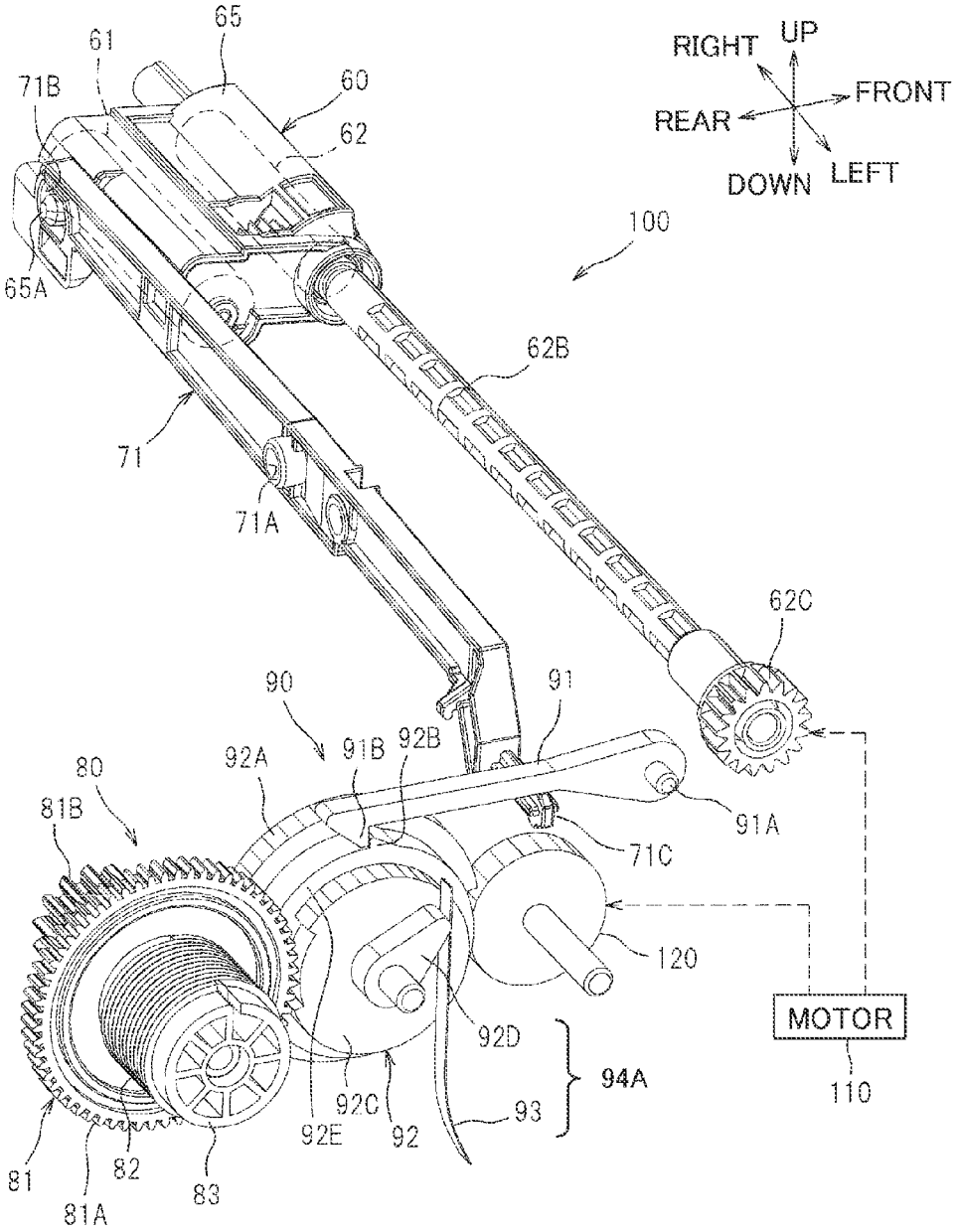
FIG. 3 is a perspective view showing a driving-force supply (feeding) mechanism.

Next, a detail arrangement of the feeder section 4 will be described below. As shown in FIGS. 2 and 3, the feeder section 4 includes a lifting mechanism 50 configured to lift the abovementioned pressing plate 51, and a driving-force supply mechanism 100 configured to supply a driving force to the lifting mechanism 50.

Here, in each diagram, sometimes, a gear tooth portion of a gear is shown to be abbreviated for the sake of expediency. In a case of showing the gear tooth portion to be abbreviated, a gear will be shown by a pitch circle.

The lifting mechanism 50 includes the abovementioned lifting plate 52, a lifting gear 54 which is rotatably provided to the paper feeding tray 11, a reduction gear 55, and an input gear 56.

The lifting gear 51 is formed to be sector-shaped, and gear teeth are formed on an outer peripheral surface thereof. An end portion of the lifting plate 52 is fixed to a lower end (an end portion in a peripheral direction) of the lifting gear 54. A center of the lifting gear 54 coincides with a rear end 53 of the lifting plate 52, or in other words, the center of the lifting gear 54 coincides with a center of rotation of the lifting plate 52.

The reduction gear 55 is a gear which transmits the driving force from the gear 56 to the lifting gear 54, and a rotational speed of the lifting gear 54 is reduced as compared to a rotational speed of the input gear 56. The reduction gear 55 has integrally a large-diameter gear portion, and a small-diameter gear portion having a diameter smaller than a diameter of the large-diameter gear portion, which is provided to the same shaft as of the large-diameter gear portion. The reduction gear 55 is arranged at a rear of the lifting gear 54, to be inclined upward, and the small-diameter gear portion thereof is engaged with the lifting gear 54, and the large-diameter gear portion thereof is engaged with the input gear 56.

The input gear 56 is arranged at a rear side of the reduction gear 55, to be inclined downward (rear side of the lifting gear 54), such that a driving force from the driving-force supply mechanism 100 which will be described later, is input to the input gear 56. More elaborately, when the paper feeding tray 11 is installed on the body 2, the input gear 56 is engaged with the driving-force supply mechanism 100 (refer to FIGS. 3 and 6: a small-diameter gear portion 81B of a clutch-side gear 81 which will be described later) provided to the body 2.

As shown in FIGS. 3 and 4, the driving-force supply mechanism 100 is provided to the body 2, and includes mainly, a motor 110 as an example of a drive source, a pickup roller assembly 60, a lifting arm 71 as an example of a coupling member, a one-way clutch mechanism 80, and a transmission-state switching mechanism 90.

The pickup roller assembly 60 is an example of a roller supporting mechanism which is supported to be able to move the pickup roller 61 vertically (upward and downward), and includes the pickup roller 61, the separating roller 62, and an idle gear 63.

The pickup roller 61 is rotatably supported by a holder 65 at a position away from a separating roller shaft 62B in a radial direction. Moreover, the separating roller 62 is also rotatably supported by the holder 65 as a shaft. Taking the opposite view, the holder 65 is pivotably supported by the separating roller 62. Moreover, the pickup roller 61 is supported by the holder 65 at a position away from a pivot shaft.

The idle gear 63 is also rotatably supported by the holder 65. A pickup roller gear 61A is formed integrally with the pickup roller 61 to have a same axis (shaft) as of the pickup roller 61. A separating roller gear 62A is formed integrally with (on) the separating roller 62, to have a same shaft as of the separating roller 62. Moreover, each of the pickup roller gear 61A and the separating roller gear 62A are engaged with the idle gear 63. A protrusion (protruding portion) 65A protruding rearward is formed on a rear portion of the holder 65.

A corrugated washer which is heretofore known but not shown in the diagram is arranged between the idle gear 63 and the holder 65. A frictional force is generated when the idle gear 63 rotates with respect to the holder 65 when the corrugated washer is strut between the idle gear 63 and the holder 65. By the frictional force generated by the corrugated washer, the holder 65 rotates in a direction of rotation when the separating roller shaft 62B rotates as it will be described later, and the rotational force generates a force which pushes the pickup roller 61 downward, or in other words, pushes the pickup roller 61 with a predetermined thrust toward the paper 3 which is located at a paper feeding position.

Moreover, the separating roller shaft 62B is rotatably provided to the body 2, and is engaged with the separating roller gear 62A upon passing through the holder 65. Rotation of the separating roller shaft 62B is transmitted to the separating roller 62, and is also transmitted to the separating roller gear 62A, and the idle gear 63 and the pickup roller gear 61A in this order, thereby rotating the pickup roller 61.

A separating roller drive gear 62C is provided at a left end of the separating roller shaft 62B. A driving force from the motor 110 is transmitted to the separating roller drive gear 62C by a heretofore known driving-force transmission switching mechanism, and accordingly, the pickup roller 61 and the separating roller 62 are rotated only at a timing of feeding paper.

Figure 4A:
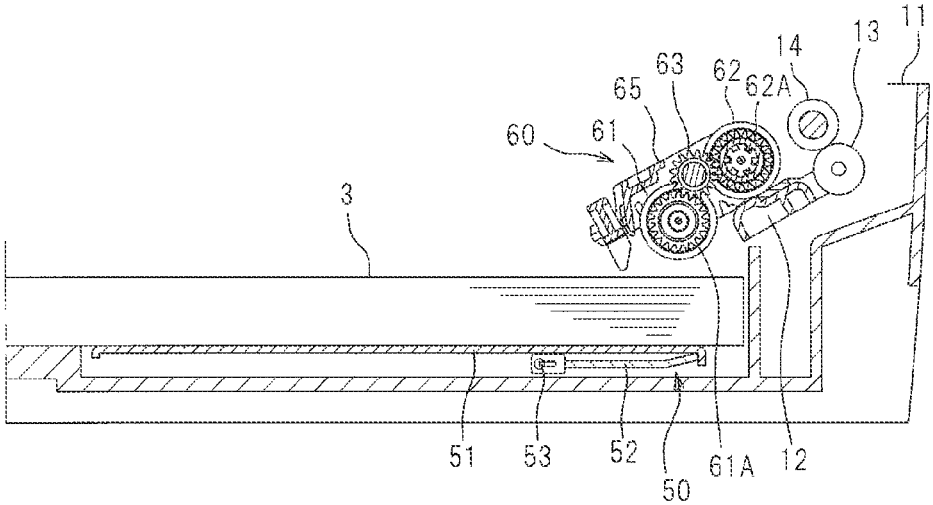
FIG. 4A and FIG. 4B are diagrams explaining a movement of a paper feeding roller and a paper, and a pressing plate, where.

The pickup roller assembly 60 is swingable around an axis (shaft) of the separating roller shaft 62B, and when the paper feeding tray 11 is installed on the body 2, the pickup roller assembly 60 is separated apart from an uppermost surface of the papers 3 which are stacked as shown in FIG. 4A. Moreover, when the papers 3 are lifted by the abovementioned lifting mechanism 50 via the pressing plate 51, the pickup roller 61 is pushed up by the papers 3. When the pickup roller 61 is lifted up to a predetermined height, a lifting movement of the pressing plate 51 by the lifting mechanism is stopped.

Moreover, as a position of the pickup roller 61 is lowered upon few to more than a dozen papers 3 being used, the pressing plate 51 is lifted up once again, and lifts the papers 3 till the pickup roller 61 attains a predetermined height. In other words, the pickup roller 61 functions as a sensor of a height-wise position of the uppermost surface of the papers 3. Such an operation has been realized by a mechanical structure in the image forming apparatus according to the embodiment.

The lifting arm 71 is swingably supported by the body 2 at a supporting point 71A of a substantial center thereof. An engaging hole 71B is formed at a right end of the lifting arm 71, and the lifting arm 71 is engaged with the protrusion 65A of the holder 65. Accordingly, the lifting arm 71 moves in conjunction with a vertical (upward and downward) movement of the pickup roller 61. Moreover, a left end 71C of the lifting arm 71 which moves in conjunction with the upward and downward movement of the pickup roller 61 is engaged with the transmission-state switching mechanism 90.

Figure 5:
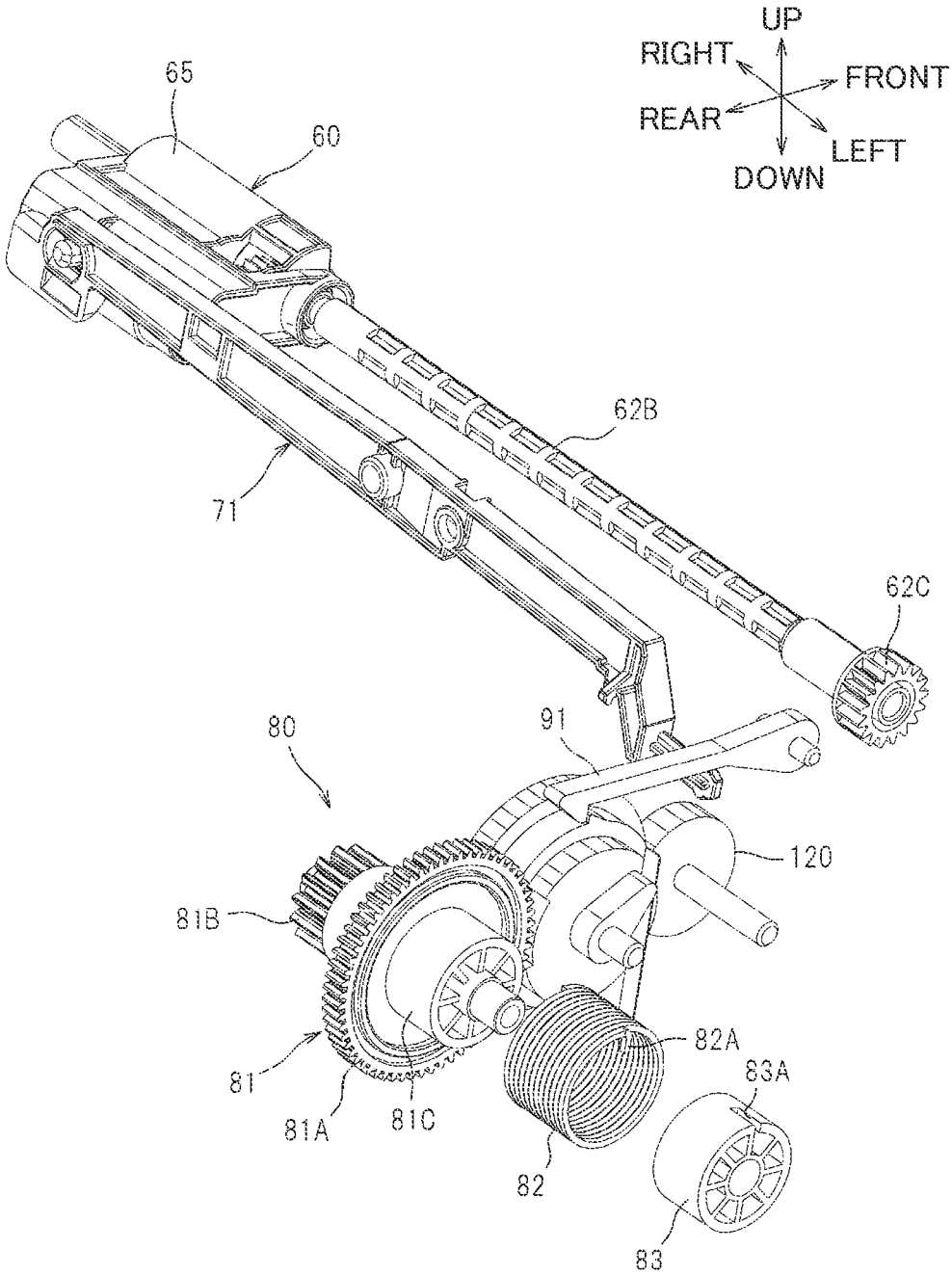
FIG. 5 is an exploded perspective view of a one-way clutch mechanism.

The one-way clutch mechanism 80 is a mechanism which transmits a driving force of the abovementioned lifting mechanism 50, and is arranged to be rotatable only in one direction (clockwise direction in the diagram) for lifting the pressing plate 51. Concretely, as shown in FIG. 5, the one-way clutch mechanism 80 includes the clutch-side gear 81, a coil spring 82, and a supporting shaft portion 83.

The clutch-side gear 81 is rotatably provided to the body 2, and has mainly, a large-diameter gear portion 81A, the small-diameter gear portion 81B, and a friction-engagement portion 81C. The large-diameter gear portion 81A is formed to have a diameter larger than a diameter of the small-diameter gear portion 81B and a diameter of the friction-engagement portion 81C. The transmission-state switching mechanism 90 (more elaborately, a second partially-toothless gear 92C) which will be described later is engaged with gear teeth formed on an outer peripheral surface of the large-diameter gear portion 81A depending on the situation, and a driving force from the transmission-state switching mechanism 90 is transmitted in a state of engagement in such manner.

The small-diameter gear portion 81B is arranged to have a shaft same as of the large-diameter gear portion 81B, and is formed integrally on an edge surface (an end surface) at an inner side in a left-right direction of the large-diameter gear portion 81A. Moreover, the small-diameter gear portion 81B is engaged with the input gear 56 of the abovementioned lifting mechanism 50.

The friction-engagement portion 81C is a component having a circular cylindrical shape arranged around the same axis as of the large-diameter gear portion 81A, and is formed integrally on an edge surface at an outer side in the left-right direction of the large-diameter gear portion 81A. The friction-engagement portion 81C is formed to have substantially same diameter as of an inner peripheral surface of the coil spring 82, and to be friction-engaged (and to have friction-engagement) with the inner peripheral surface of the coil spring 82.

The coil spring 82 is provided to be fitted from an outer side to the friction-engagement portion 81C, and an end portion 82A at an outer side of the left-right direction of the coil spring 82 is fixed to the body 2 by being engaged with an engaging groove 83A formed in the supporting shaft portion 83. The supporting shaft portion 83 is formed on the body 2, and is formed to have a diameter smaller than the diameter of the inner peripheral surface of the coil spring 82.

In the one-way clutch mechanism 80, at the time of rotating the clutch-side gear 81 in a clockwise direction in the diagram, the friction-engagement portion 81C rotates in a direction of loosening the coil spring 82. Then, the friction between the friction-engagement portion 81C and the coil spring 82 becomes small, and the clutch-side gear 81 rotates. Moreover, at the time of rotating the clutch-side gear 81 in a counterclockwise direction in the diagram, the friction-engagement portion 81C rotates in a direction of tightening the coil spring 82. Then, the friction between the friction-engagement portion 81C and the coil spring 82 becomes large, and rotation of the clutch-side gear 81 is inhibited.

Since the clutch-side gear 81 is rotatable only in one direction (direction of lifting the pressing plate 51) due to the friction-engagement of the coil spring 82 and the friction-engagement portion 81C in such manner, it is possible to suppress the pressing plate 51 from being lowered due to a weight of the papers 3, by the one-way clutch mechanism 80.

Figure 6:
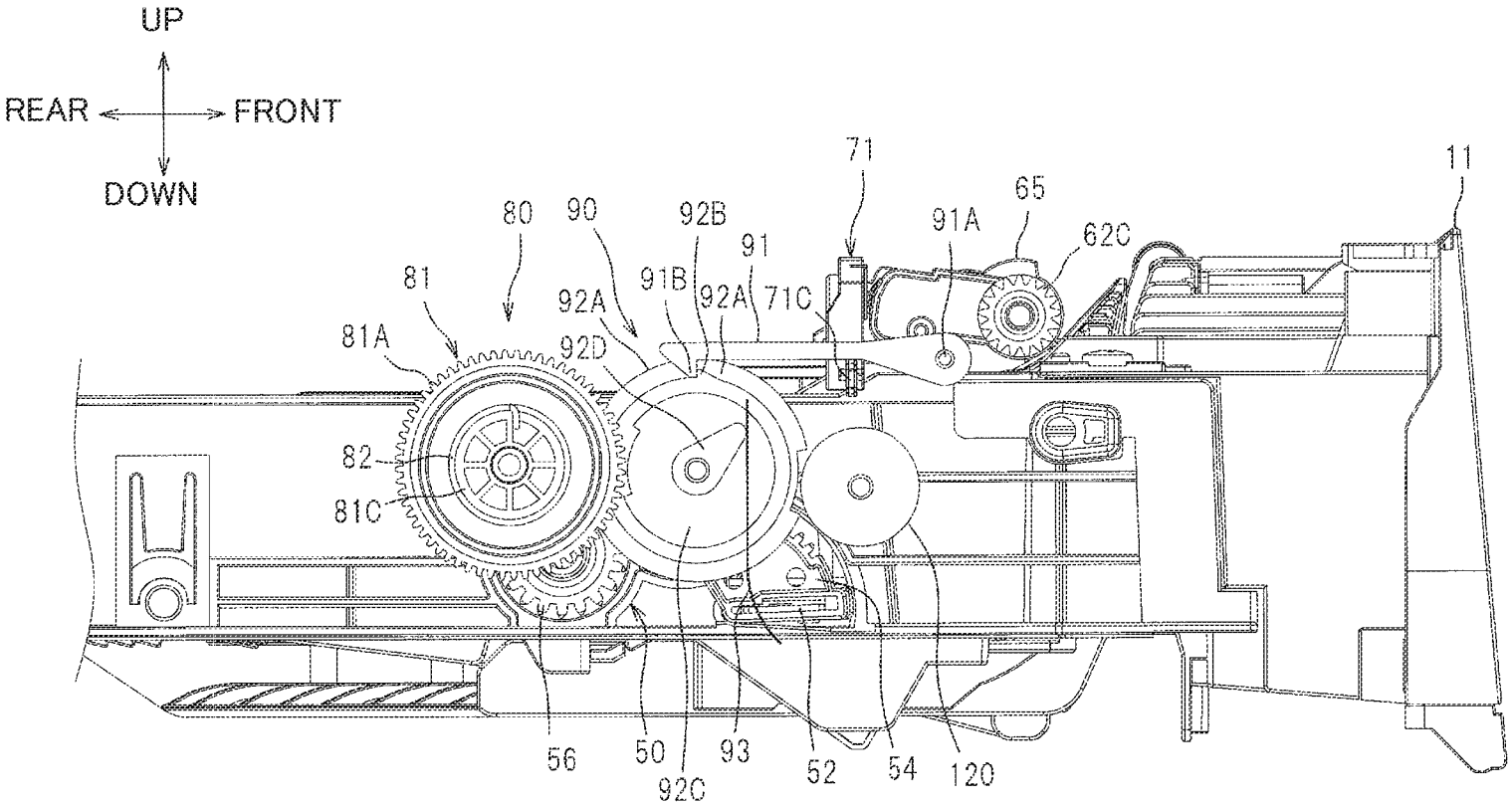
FIG. 6 is a side view showing the ascending mechanism and the driving-force supply (feeding) mechanism in a state of the paper feeding tray installed on an body.

As shown in FIGS. 3 and 6, the transmission-state switching mechanism 90 is arranged between a drive gear 120 which is rotated by a driving force from the motor 110 and the one-way clutch mechanism 80, so that the transmission-state switching mechanism 90 allows or inhibits the transmission of the drive force from the drive gear 120 to the one-way clutch mechanism 80. Concretely, the transmission-state switching mechanism 90, configured to carry out switching of transmission of the driving force in accordance with the movement of the lifting arm 71, includes mainly, a locking arm 91 as an example of a locking member, a two stage partially-toothless gear 92, and a plate spring (flat spring) 93 as an example of a bias applying member.

The locking arm 91 is a long member extended in a frontward-rearward direction. A pivot shaft 91A which is rotatably supported by the body 2 is formed at a front-end portion of the locking arm 91, and a claw portion 91B which is protruded downward and engaged with an engaging portion 92B which will be described later is formed at a rear-end portion of the locking arm 91. The left end 71C of the lifting arm 71 is arranged at a lower side of the locking arm 91, and the left end 71C is engageable with the locking arm 91 from a lower side.

Accordingly, the claw portion 91B of the locking arm 91 is pivoted upward in conjunction with the movement of the lifting arm 71 (turning in a counterclockwise direction in FIG. 3) as a result of the downward movement of the pickup roller 61, and is disengaged from the engaging portion 92B. Moreover, the claw portion 91B of the locking arm 91 is pivoted downward in conjunction with the movement of the lifting arm (turning in a clockwise direction in FIG. 3) as a result of the upward movement of the pickup roller 61, and is engaged with the engaging portion 92B.

Accordingly, in a case of pushing up the pickup roller 61 by elevation of the pressing plate 51 as it will be described later, by lowering of the left end 71C due to the lifting arm 71 being turned in the clockwise direction in the diagram, the claw portion 91B of the locking arm 91 is swung downward and is engaged with the engaging portion 92B. At this time, the driving force to the pressing plate 51 is cut off.

Moreover, the left end 71C is lifted gradually due to the turning of the lifting arm 71 in the counterclockwise direction in the diagram when the pickup roller 61 moves downward. Then, an amount of engagement of the engaging portion 92B and the claw portion 91B of the locking arm 91 goes on becoming smaller gradually. Moreover, when the pickup roller 61 has moved near a lowermost position, the claw portion 91B of the locking arm 91 is disengaged from the engaging portion 92B. Accordingly, during the time when a predetermined number of papers 3 is used as it will be described later, the claw portion 91B of the lifting arm 91 is maintained in a state of being engaged with the engaging portion 92B. In other words, the claw portion 91B of the lifting arm 91 is maintained in a state in which the driving force to the pressing plate 51 is cut off. When the predetermined number of papers 3 is used and the pickup roller 61 has moved near the lowermost position, the claw portion 91B of the locking arm 91 is disengaged from the engaging portion 92B (the driving force is transmitted to the pressing plate 51).

The two stage partially-toothless gear 92 is rotatably supported by the body 2, and mainly includes integrally, a first partially-toothless gear 92A, the engaging portion 92B, a second partially-toothless gear 92C, and a cam portion 92D.

A part of an outer periphery of the first partially-toothless gear 92A is formed as a gear-teeth portion to which the driving force from the drive gear 120 is transmitted, and a remaining part of the outer periphery of the first partially-toothless gear 92A is formed as a partially-toothless portion to which the driving force from the drive gear 120 is not transmitted. The first partially-toothless gear 92A is arranged to be adjacent to the drive gear 120 in a radial direction.

The engaging portion 92B is a portion with which the claw portion 91B of the locking arm 91 is engaged. The engaging portion 92B is formed to be protruded in a radial direction from an outer peripheral surface of a small-diameter portion 92E provided to an edge surface on an outer side in a left-right direction of the first partially-toothless gear 92A. Therefore, the engaging portion 92B rotates in conjunction with the first partially-toothless gear 92A. The small-diameter portion 92E is formed integrally with the edge surface on the outer side in the left-right direction of the first partially-toothless gear 92A, to be coaxial (to be concentric) with the first partially-toothless gear 92A and to have a diameter smaller than the diameter of the first partially-toothless gear 92A.

The second partially-toothless gear 92C is formed integrally with an edge surface on an outer side in a left-right direction of the small-diameter portion 92E, to be coaxial with the small-diameter portion 92E, and to have a diameter smaller than the diameter of the small-diameter portion 92E. A part of an outer periphery of the second partially-toothless gear 92C is formed as a gear-teeth portion which transmits the driving force to the one-way clutch mechanism 80, and a remaining part of the outer periphery of the second partially-toothless gear 92C is formed as a partially-toothless portion which does not transmit the driving force to the one-way clutch mechanism 80. The second partially-toothless gear 92C is arranged adjacent to the large-diameter gear portion 81A of the clutch-side gear 81 in a radial direction.

Moreover, when the claw portion 91B of the locking arm 91 is engaged with the engaging portion 92B, the partially-toothless portion of each of the abovementioned first partially-toothless gear 92A and the second partially-toothless gear 92C faces the large-diameter gear portion 81A of the clutch-side gear 81 and the drive gear 120 (a mechanism on an upstream side and a mechanism on a downstream side of the two stage missing gear 92 in a direction of transmission of the driving force). Accordingly, when the claw portion 91B of the locking arm 91 is engaged with the engaging portion 92B, transmission of the driving force from the drive gear 120 to the clutch-side gear 81 (the lifting mechanism 50) is inhibited.

The cam portion 92D is formed integrally with an edge surface on an outer side in a left-right direction of the second partially-toothless gear 92C, and rotates in conjunction with the first partially-toothless gear 92A. The cam portion 92D is formed as a substantially egg-shaped cam of which a width is narrowed gradually, extending from a center of rotation toward an outer-side of radial direction of the two stage partially-toothless gear 92.

A lower-end portion of the plate spring 93 is fixed to the body 2, in a state of being bent between the cam portion 92D and the body 2, so that a bias is applied in a rearward direction to a front-end portion which is an upper-end portion and a taper end of the cam portion 92D, when at least the claw portion 91B of the locking arm 91 is engaged with the engaging portion 92B. In other words, in the embodiment, a bias applying mechanism 94A which applies a bias in the counterclockwise direction in the diagram (a direction for lifting the pressing plate 51), to the first partially-toothless gear 92A and the second partially-toothless gear 92C, is formed by the plate spring 93 and the cam portion 92D.

Figure 7A:
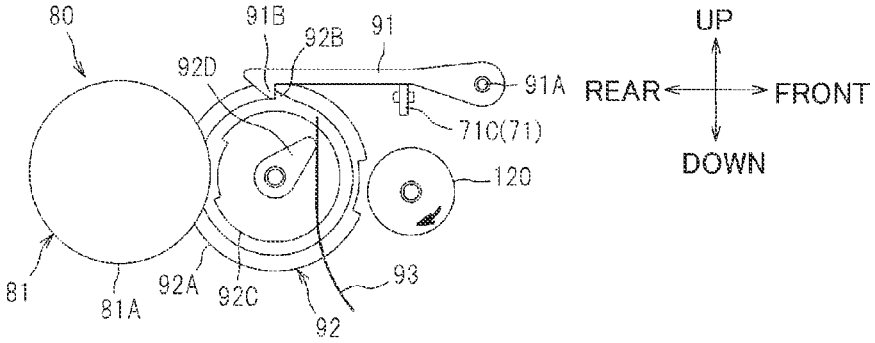
FIG. 7A, FIG. 7B, FIG. 7C, and FIG. 7D are diagrams explaining an operation of a transmission-state switching mechanism, where.
Figure 7B:
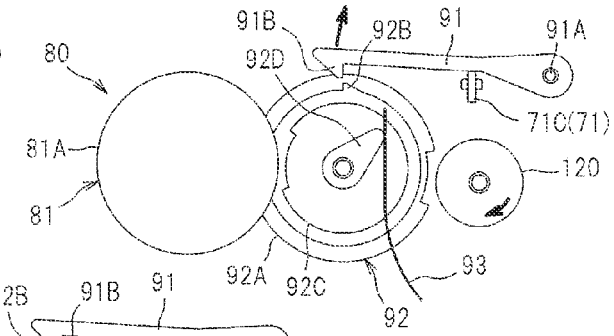
Figure 7C:
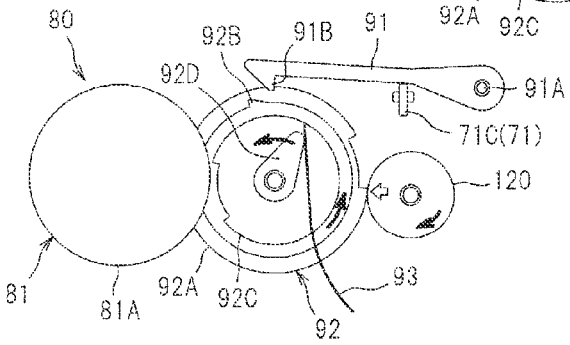

Moreover, by providing such plate spring 93 and the cam portion 92D, when the claw portion 91B of the locking arm 91 is disengaged from the engaging portion 92B as shown in FIG. 7A and FIG. 7B, the plate spring 93 pushes rearward the front-end portion of the cam portion 92D as shown in FIG. 7C. Then, the two stage partially-toothless gear 92 is turned, and the first partially-toothless gear 92A is engaged with the drive gear 120 (refer to a white arrow mark in FIG. 7C). Accordingly, the driving force from the drive gear 120 is transmitted to the two stage partially-toothless gear 92, and the two stage partially-toothless gear 92 rotates.

At a point of time at which, the first partially-toothless gear 92A and the drive gear 120 are engaged in such manner (a state in FIG. 7C), still, the second partially-toothless gear 92C is not engaged with the large-diameter gear portion 81A of the clutch-side gear 81. In other words, when the two stage partially-toothless gear 92 rotates due to the plate spring 93 pushing the cam portion 92D, the gear-tooth portion of the first partially-toothless gear 92A is engaged with the drive gear 120 before the gear-tooth portion of the second partially-toothless gear 92C is engaged with the large-diameter gear portion 81A of the clutch-side gear 81.

Accordingly, it is possible to set the bias applied by the plate spring 93 to be weak as compared to a case in which the timing of engagement is reversed.

Figure 7D:
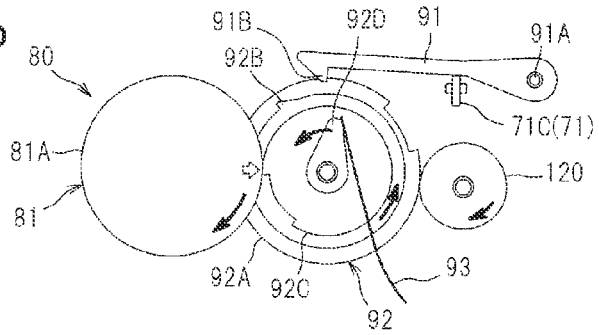

Moreover, when the two stage partially-toothless gear 92 is turned by a predetermined amount by the driving force from the drive gear 120, the second partially-toothless gear 92C is engaged with the large-diameter gear portion 81A of the clutch-side gear 81 as shown in FIG. 7D (refer to a white arrow mark in FIG. 7D). Accordingly, the driving force of the drive gear 120 is transmitted to the lifting mechanism 50 via the two stage partially-toothless gear 92 and the clutch-side gear 81 (refer to FIG. 6).

Thereafter, each of the drive gear 120, the two stage partially-toothless gear 92, and the clutch-side gear 81 rotates in conjunction during the time till the first partially-toothless gear 92A is disengaged from the drive gear 120 (till the partially-toothless portion is facing the drive gear 120). Moreover, at this time, the cam portion 92D, by turning from a direction in FIG. 7D to an initial direction shown in FIG. 7A, pushes the plate spring 93 frontward and returns to an initial state (state in which the bias has been stored).

Therefore, after the two stage partially-toothless gear 92 has rotated once (has completed one rotation), when the claw portion 91B of the locking arm 91 is in the same state of being disengaged from the engaging portion 92B, the two stage partially-toothless gear 92 rotates with the bias of the plate spring 93 as a cue once again, and the driving force is transmitted from the drive gear 120 to the lifting mechanism 50 once again. In other words, while the claw portion 91B of the locking arm 91 is in a state of being disengaged from the engaging portion 92B, the transmission of the driving force from the drive gear 120 to the lifting mechanism 50 is allowed (more elaborately, the driving force is supplied intermittently).

An operation of the laser printer 1 structured as described above will be explained by referring mainly to points which are peculiar to the present teaching. As shown in FIG. 6, when the paper feeding tray 11 is installed on the body 2, the input gear 56 and the clutch-side gear 81 (the small-diameter gear portion 81B shown in FIG. 3) of the lifting mechanism 50 are engaged. At this time, the pressing plate 51 is in a state of being lain at a bottom surface of the paper feeding tray 11 as shown in FIG. 4A. Moreover, an uppermost surface of the papers 3 which are stacked is isolated from the pickup roller 61 which is positioned at the lowermost position.

In a state in FIG. 4A, a left side of the lifting arm 71 is lifted as a side on the pickup roller side 61 (right side of the lifting arm 71) is lowered. Therefore, as shown in FIG. 7B, the locking arm 91 is elevated by the left end 71C of the lifting arm 71, and the claw portion 91B is in a state of being disengaged from the engaging portion 92B.

Figure 4B:
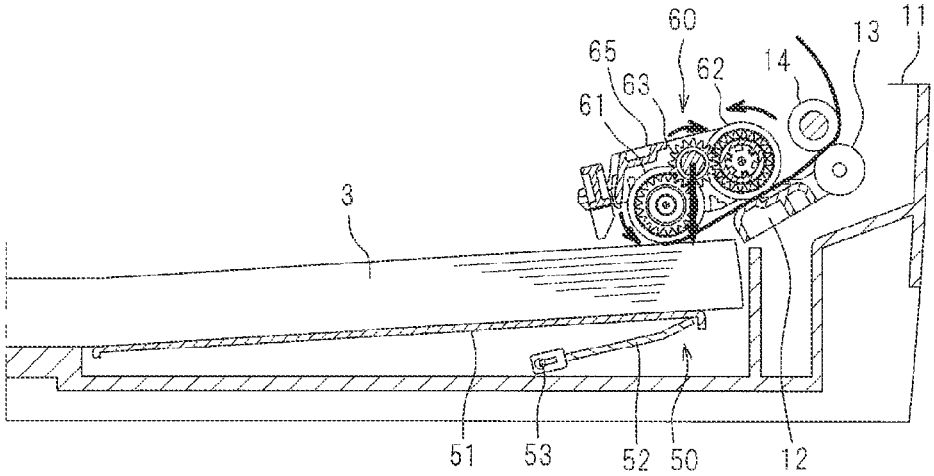

Accordingly as a power supply to the laser printer 1 is put on and the motor 110 is driven, the operation in diagrams from FIG. 7B to FIG. 7D is repeated, and the pressing plate 51 is lifted. Moreover, as shown in FIG. 4B, as the pressing plate 51 lifts the pickup roller 61 via the papers 3, the lifting arm 71 is swung in conjunction with the movement of the pickup roller 61 to the paper feeding position, and as shown in FIG. 7A, the locking arm 91 descends together with the left end 71C of the lifting arm 71, and the claw portion 91B is engaged with the engaging portion 92B.

Accordingly, the transmission of the driving force from the drive gear 120 to the clutch-side gear 81 is cut off and the pressing plate 51 and the pickup roller 61 assume a state of being capable of feeding paper. At this time, by an action of the one-way clutch mechanism 80, since the pressing plate 51 is suppressed from being lowered, the pressing plate 51 is maintained at an appropriate position.

Moreover, as the papers 3 on the pressing plate 51 go on decreasing gradually by paper feeding by the pickup roller 61, the pickup roller 61 is also lowered gradually with the decreasing of the papers 3. The left end 71C of the lifting arm 71 and the claw portion 91B of the locking arm 91 ascend gradually in conjunction with the movement of lowering of the pickup roller 61, and the amount of engagement of the claw portion 91B and the engaging portion 92B goes on decreasing gradually. Moreover, as the pickup roller 61 moves once again to the lowermost position, the claw portion 91B is disengaged from the engaging portion 92B, and the driving force is transmitted from the drive gear 120 to the clutch-side gear 81, and the abovementioned operation is repeated.

In a case in which the paper feeding tray 11 is removed from the body 2, the input gear 56 is disengaged from the clutch-side gear 81 (the one-way clutch mechanism 80). Then, the input gear 56 becomes free. Therefore, the pressing plate 51 is lowered due to its weight, thereby returning to a state of being lain at the bottom surface of the paper feeding tray 11.

According to the embodiment described above, it is possible to achieve the following effect in addition to the abovementioned effect. Since the transmission-state switching mechanism 90 is formed by one locking arm 91, the two stage partially-toothless gear 92, and the plate spring 93, it is possible to simplify the structure of the transmission-state switching mechanism 90 as compared to a conventional structure in which the transmission-state switching mechanism is formed by using a planetary gear mechanism and a plurality of locking members.

Since the first partially-toothless gear 92A, the engaging portion 92B, the second partially-toothless gear 92C, and the cam portion 92D are formed integrally, it is possible to reduce the number of components, and phase management of each partially-toothless portion, the engaging portion 92B, and the cam portion 92D becomes easy. Therefore, it is possible to bring the transmission-state switching mechanism 90 into operation assuredly.

Since the one-way clutch mechanism 80 is formed by the clutch-side gear 81 (the friction-engagement portion 81C), the coil spring 82, and the supporting shaft portion 83, it is possible to let the structure to be simple as compared to one-way clutch mechanisms having another structure.

The present teaching is not restricted to the embodiment described above, and can be used in various modes as exemplified below. In the following description, same reference numerals are assigned to members having a substantially similar structure as in the embodiment, and the description of such members is omitted.

Figure 8A:
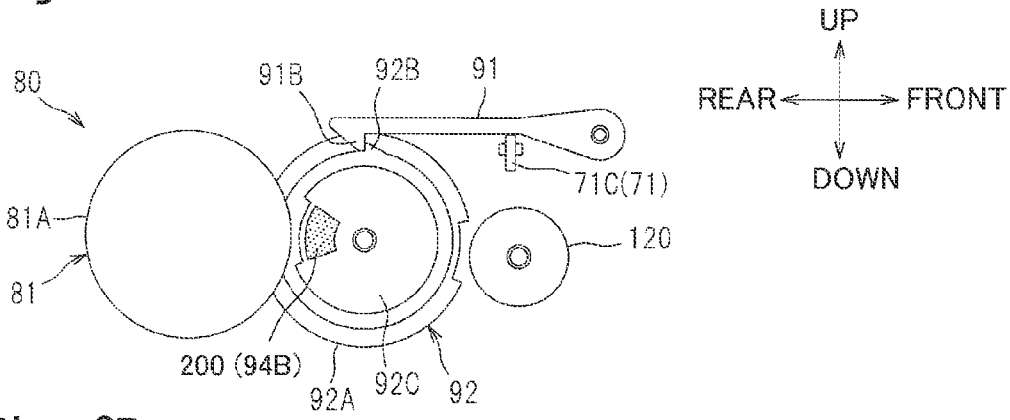
FIG. 8A and FIG. 8B are diagrams showing modified embodiments of a bias applying mechanism.

In the embodiment, the bias applying mechanism 94A is formed by the plate spring 93 and the cam portion 92D. However, the present teaching is not restricted to such formation of the bias applying mechanism 94A, and a spindle member 200 may be the bias applying mechanism 94B as shown in FIG. 8A for example.

Concretely, in this structure, the spindle member 200 and the two stage partially-toothless gear 92 are provided instead of the plate spring 93 and the cam portion 92D in the embodiment. More elaborately, the spindle member 200 is provided at a rear side of a rotating shaft of the two stage partially-toothless gear 92 such that, in a state of the claw portion 91B of the locking arm 91 being engaged with the engaging portion 92B, a force in the counterclockwise direction in the diagram is applied to the two stage partially-toothless gear 92. Even in this case, by the weight of the spindle member 200, it is possible to apply a bias to the two stage partially-toothless gear 92.

Figure 8B:
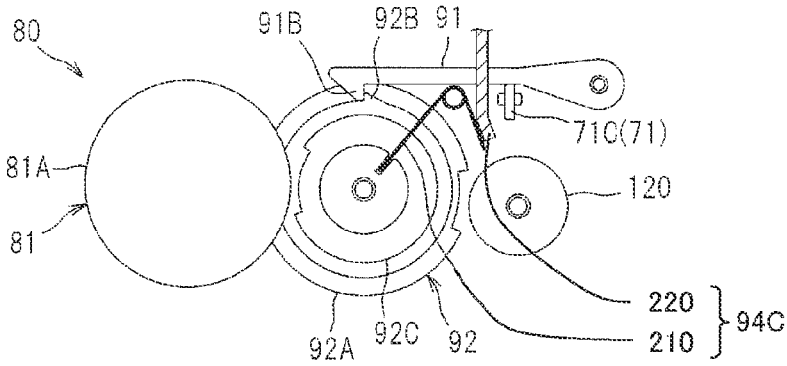

Moreover, as shown in FIG. 8B, the bias applying mechanism 94C may include a torsion spring 210 fixed to the two stage partially-toothless gear 92 and an engaging wall 220 provided to the body 2. Concretely, in this structure, the torsion spring 210 and the engaging wall 220 are provided instead of the plate spring 93 and the earn portion 92D in the embodiment.

One end of the torsion spring 210 is fixed to the two stage partially-toothless gear 92, and the torsion spring 210 is rotatable integrally with the two stage partially-toothless gear 92. In the state of the claw portion 91B of the locking arm 91 being engaged with the engaging portion 92B, the torsion spring 210 is retracted between the two stage partially-toothless gear 92 and the engaging wall 220 by the other end of the torsion spring 210 being engaged with the engaging wall 220. Even in this case, it is possible to apply bias in the anticlockwise direction in the diagram, from the torsion spring 210 to the two stage partially-toothless gear 92.

Figure 9:
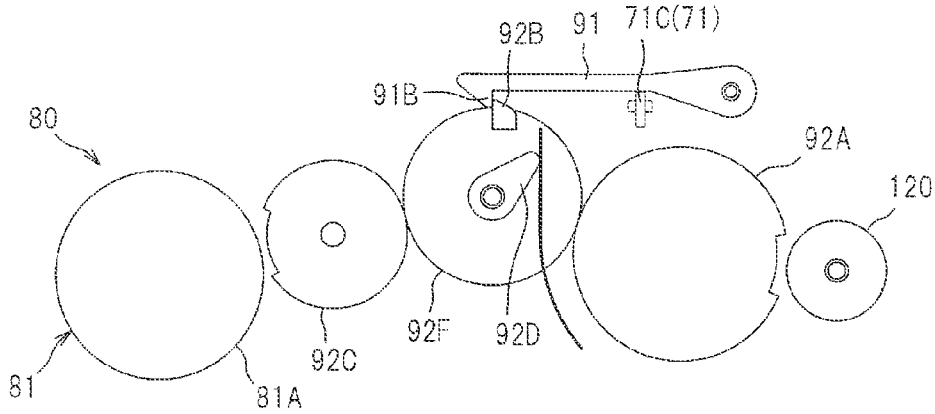
FIG. 9 is a diagram showing an embodiment (a configuration) in which, the first partially-toothless gear and the second partially-toothless gear are different components.

In the embodiment, the first partially-toothless gear 92A, the engaging portion 92B, the second partially-toothless gear 92C, and the cam portion 92D are formed integrally. However, the present teaching is not restricted to such an arrangement, and the abovementioned components may be formed as separate components. For instance, each of the first partially-toothless gear 92A and the second partially-toothless gear 92C may be formed as one gear, and an intermediate gear 92F which has the engaging portion 92B and the cam portion 92D may be provided between the two gears as shown in FIG. 9. Even in this case, it is possible to show an action and effect similar as in the embodiment.

In the embodiment, the locking arm 91 which is swingable is exemplified as a locking member. However, the present teaching is not restricted to such an arrangement, and it may be a locking member which moves rectilinearly.

In the embodiment, the one-way clutch mechanism 80 is provided to the body 2. However, the present teaching is not restricted to such an arrangement, and the one-way clutch mechanism may be provided to the paper feeding tray. Moreover, in the embodiment, the outer peripheral surface of the coil spring 82 is friction-engaged with the outer peripheral surface of the friction-engagement portion 81C. However, the present teaching is not restricted to such an arrangement, and the outer peripheral surface of the coil spring may be friction-engaged with an inner peripheral surface of a friction-engagement portion having a circular cylindrical shape.

In the embodiment, a paper 3 such as a board paper, a post card, and a thin paper is used as an example of a sheet. However, the present teaching is not restricted to the above-mentioned sheet materials, and it may be an OHP (overhead projector) sheet.

In the embodiment, the present teaching is applied to the laser printer 1. However, the application of the present teaching is not restricted to this, and the present teaching may also be applied to other image forming apparatuses such as a copy machine and a multi-function device.

In the embodiment, the plate spring 93 has been exemplified as a bias applying member. However, the present teaching is not restricted to such an arrangement, and the bias applying member may be a torsion spring or a wire spring.

In the embodiment, the gear teeth portion of the first partially-toothless gear is engaged with the mechanism on the upstream side before the gear teeth portion of the second partially-toothless gear is engaged with the mechanism on the downstream side. However, the present teaching is not restricted to such an arrangement, and the gear teeth portion of the second partially-toothless gear can be engaged with the mechanism on the downstream side before the gear teeth portion of the first partially-toothless gear is engaged with the mechanism on the upstream side. In this case, by increasing the bias applied by the bias applying mechanism, the first partially-toothless gear and the second partially-toothless gear are rotated even after the gear teeth portion of the second partially-toothless gear is engaged with the mechanism on the downstream side, and thereafter, the gear teeth portion of the first partially-toothless gear is engaged with the mechanism on the upstream side. Moreover, the timing of engagement may be simultaneous.

What is claimed is:

1. An image forming apparatus configured to form an image onto a sheet, comprising:

a body;

a feeding tray configured to receive stacking of a plurality of sheets thereon;

a pickup roller configured to contact with an uppermost sheet of the sheets stacked on the feeding tray, from an upper side;

a roller supporting mechanism configured to support the pickup roller to be movable in upward and downward directions;

a pressing plate swingably provided to the feeding tray and configured to lift up the sheets at a time of feeding the sheets;

a lifting mechanism configured to lift the pressing plate;

a drive source provided to the body;

a drive gear configured to rotate by a driving force transmitted from the drive source;

a one-way clutch mechanism configured to rotate only in one direction, and configured to transmit the driving force to the fitting mechanism;

a coupling member configured to move in conjunction with a movement of the pickup roller in the upward and downward directions; and a transmission-state switching mechanism engaged with the coupling member, and configured to allow or inhibit the transmission of the driving force from the drive gear to the one-way clutch mechanism, in accordance with movement of the coupling member, wherein the transmission-state switching mechanism includes:

a first partially-toothless gear of which a part of an outer periphery is formed as a gear tooth portion to which the driving force is transmitted from the drive gear, and a portion other than the part of the outer periphery is formed as a partially-toothless portion to which the driving force is not transmitted from the drive gear, a second partially-toothless gear of which a part of an outer periphery is formed as a gear tooth portion which transmits the driving force to the one-way clutch mechanism, and a portion other than the part of the outer periphery is formed as a partially-toothless portion which does not transmit the driving force to the one-way clutch mechanism, an engaging portion configured to rotate in conjunction with the first partially-toothless gear, a locking member configured to be engaged with the engaging portion in conjunction with the movement of the coupling member due to an upward movement of the pickup roller, and configured to be disengaged from the engaging portion in conjunction with the movement of the coupling member due to a downward movement of the pickup roller, and a bias applying mechanism configured to apply a bias in the one direction to the first partially-toothless gear and the second partially-toothless gear at a time when at least the locking member engages with the engaging portion, wherein, in the transmission-state switching mechanism, at the time when the locking member engages with the engaging portion, each partially-toothless portion of the first partially-toothless gear and the second partially-toothless gear faces a mechanism on an upstream side of the first partially-toothless gear, and a mechanism on a downstream side of the second partially-toothless gear, and wherein, under a condition that the locking member is disengaged from the engaging portion, the first partially-toothless gear and the second partially-toothless gear are rotated by the bias applying mechanism, and a gear-tooth portion of the first partially-toothless gear is engaged with the mechanism on the upstream side.

2. The image forming apparatus according to claim 1, wherein, under a condition that the first partially-toothless gear and the second partially-toothless gear are rotated by the bias applying mechanism, a gear-tooth portion of the first partially-toothless gear is engaged with the mechanism on the upstream side before a gear-tooth portion of the second partially-toothless gear is engaged with the mechanism on the downstream side.

3. The image forming apparatus according to claim 1, wherein the bias applying mechanism includes:

a cam portion configured to rotate in conjunction with the first partially-toothless gear, and a bias applying member configured to apply a bias to the cam portion in one direction, and which is pushed in a direction opposite to the one direction by the cam portion to be returned to an initial position.

4. The image forming apparatus according to claim 3, wherein the first partially-toothless gear, the second partially-toothless gear, the engaging portion, and the cam portion are formed integrally.

5. The image forming apparatus according to claim 1, wherein:

the one-way clutch mechanism includes:

a coil spring of which one end is fixed to the body or the feeding tray, a clutch-side gear to which the drive force is transmitted from the second partially-toothless gear, and a friction-engagement portion provided to the clutch-side gear, and which is friction-engaged with one of an inner-peripheral surface and an outer-peripheral surface of the coil spring; and the clutch-side gear is configured to rotate in only one direction due to friction engagement of the coil spring and the friction engagement portion.

6. The image forming apparatus according to claim 1, wherein the lifting mechanism is configured so that:

under a condition that the pickup roller is lifted up to a predetermined height by being pushed up by the sheets, a lifting movement of the pressing plate stops, and under a condition that a position of the pickup roller is lowered, the lifting mechanism lifts the pressing plate such that the pickup roller is lifted up to the predetermined height by being pushed up by the sheets.

* * * * *